US006553739B2

(12) United States Patent
Richardson

(10) Patent No.: US 6,553,739 B2
(45) Date of Patent: Apr. 29, 2003

(54) ROOF BEAMS

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 116 days.

(21) Appl. No.: 09/790,925

(22) Filed: Feb. 22, 2001

(65) Prior Publication Data

US 2001/0017011 A1 Aug. 30, 2001

(30) Foreign Application Priority Data

Feb. 26, 2000 (GB) ..... 0004521

(51) Int. Cl.[7] ..... E04D 3/08

(52) U.S. Cl. ..... 52/734.2; 52/204.71; 52/90.1; 52/465; 52/DIG. 17

(58) Field of Search ..... 52/90.1, 204.5, 52/204.53, 204.71, 282.1, 461, 465, 764, 769, 734.1, 734.2, 98, DIG. 17

(56) References Cited

U.S. PATENT DOCUMENTS

| | | | | | |
|---|---|---|---|---|---|
| 3,199,258 | A | * | 8/1965 | Jentoft et al. | 52/222 |
| 4,070,806 | A | | 1/1978 | Hubbard | |
| 5,617,684 | A | * | 4/1997 | Sheath | 52/204.57 |
| 5,937,590 | A | * | 8/1999 | Richardson | 52/82 |
| 6,000,176 | A | * | 12/1999 | Lancaster | 52/198 |
| 6,223,481 | B1 | * | 5/2001 | Rickman | 52/460 |

FOREIGN PATENT DOCUMENTS

| | | | | | |
|---|---|---|---|---|---|
| EP | 0610102 | A1 | * | 8/1994 | E04D/3/14 |
| EP | 0 924 362 | A2 | | 12/1998 | |
| EP | 933 490 | A2 | | 8/1999 | |
| FR | 1124040 | | * | 10/1956 | 52/465 |
| FR | 2 455 158 | | | 11/1980 | |
| GB | 796176 | | | 6/1955 | |
| GB | 2211536 | A | * | 7/1989 | E04D/3/08 |
| GB | 2236791 | A | * | 4/1991 | E06B/3/68 |
| GB | 2 259 937 | A | | 3/1993 | |
| GB | 2 287 493 | A | | 9/1995 | |
| GB | 2307263 | A | * | 5/1997 | E06B/3/54 |
| GB | 2335696 | A | * | 9/1999 | E04D/3/08 |
| GB | 2 345 937 | A | | 7/2000 | |
| GB | 2 347 963 | A | | 9/2000 | |
| WO | WO 91/14056 | | | 9/1991 | |
| WO | WO 94/13920 | | * | 6/1994 | 52/204.5 |
| WO | WO 00/55448 | | | 9/2000 | |

* cited by examiner

*Primary Examiner*—Carl D. Friedman
*Assistant Examiner*—Brian E. Glessner
(74) *Attorney, Agent, or Firm*—Wood, Phillips, Katz, Clark & Mortimer

(57) ABSTRACT

In a roof beam for a conservatory roof, an upper capping has two sides and has gasket material attached to inwards edges of inwards returns of the sides so as to be substantially hidden by those returns, for sealing on glazing panels supported on glazing bars. Those returns are connected to the sides by lines of weakness, whereby those returns can reflex.

27 Claims, 4 Drawing Sheets

ROOF BEAMS

TECHNICAL FIELD OF THE INVENTION

This invention concerns roof beams, especially for use in constructing conservatories and like structures having roofs comprising panels usually of translucent material supported between roof beams.

BACKGROUND OF THE INVENTION

Translucent panels for conservatory roofs are generally sandwiched at their edges between upper and lower roof beam forming extrusions or cappings coupled to a glazing bar, usually of aluminum. To provide a good seal above and below the translucent panels, provisions are made for the roof beam to retain gaskets in suitable positions.

Upper roof beam forming extrusions or cappings may have gaskets formed integrally with panel contacting edges thereof and gaskets for the underside of the panels are usually retained in special formations of he aluminium glazing bars. These gaskets have to be fitted to the extrusions on site which takes up time. Also, the extrusions are more expensive to produce because of the additional gasket retaining formations required.

Furthermore, in order to retain the lower beam forming cappings, the aluminium glazing bars require further formations on which the lower beam cappings can locate.

In GB2275958A it was proposed to provide a roof beam construction for use in constructing conservatory roofs comprising a glazing bar and upper and lower cappings therefor having gaskets formed integrally on edges thereof between which a roofing panel is to be retained and means for locating the cappings on said glazing bar, wherein the means for locating the lower capping on the glazing bar comprises the integrally formed gaskets, which in use are trapped between the glazing bar and roofing panel.

The lower cappings are formed with either a flat base or with a base having a pair of angled longitudinal facets. For each type of capping the glazing bar, generally an inverted T in section, has its cross bar correspondingly shaped, ie. either flat or with two angled facets. In forming Victorian style conservatories, both types of glazing bar will usually be used. The glazing bars with the flat base and corresponding cappings are usually used as transom bars extending from opposite sides of a ridge of the conservatory to the eaves and the angled base glazing bars with corresponding cappings are used for forming the Victorian roof end, which is formed with triangular section roofing panels. Thus, in forming a Victorian style conservatory, two different types of glazing bar and lower cappings are required, which adds to the cost. Furthermore, care has to be taken when erecting such a conservatory to ensure that glazing bars are installed in the correct positions.

In GB2315800A we proposed providing a glazing bar for use in forming roof beams of conservatory roofs, the glazing bar being of generally inverted T-section having an, in use, upstanding limb to which an upper capping may be fixed, and a cross bar having a central section and edges, the edge being shaped to extend below the central section to form a recess in the underside of the cross bar. This spacing gave rise to the possibility of the same glazing bar being used for transom and Victorian situations as defined above.

As mentioned above upper cappings for glazing bars have gaskets formed integrally along edges thereof and these are compressed onto and spread outwardly on the roofing panels. The gasket material is usually black and is, of course, visible along edges of the cappings. However, the gasket material can become distorted or discoloured in patched, which detrimentally affects the appearance of the roof.

An object of this invention is to deal with the above-mentioned problem.

According to this invention there is provided a roof beam construction for use in constructing conservatory roofs comprising a glazing bar and on an upper capping therefor having gaskets along edges thereof for sealing a roofing panel to be supported by the glazing bar and means for locating the capping on the glazing bar, wherein the upper capping has its sides stepped inwardly and its gasket material on inwards ends of said stepped sides.

Thus, the gasket material along edges of the upper cappings is spaced inwardly from sides of the cappings and so is substantially hidden beneath the stepped sides when the cappings are in place.

The gasket material may be provided on the cappings in any suitable way. Typically co-extrusion is a suitable technique as is co-bonding.

In a preferred embodiment of the invention the stepped sides of the upper capping form inwards returns that are resiliently flexible, so that the gasket material presses onto the roofing panels to improve contact therewith. The returns may be connected to the sides of the upper capping by lines of weakness allowing them to flex relative to the sides.

In a preferred embodiment of the invention upper cappings have a top and at least one other depending side that is stepped inwardly at its bottom end and has gasket material on a free edge of said stepped bottom end. The upper cappings are preferably extrusions of plastics material, such as polyvinyl chloride and gaskets are preferably of rubber or synthetic elastomeric materials possibly co-extruded with the cappings or bonded thereto. The gasket material is preferably in the form of a strip having two divergent facets that spread outwardly in use. Internally of the capping, formations are provided whereby the capping can be coupled to the glazing bar.

Preferably resilient formations depend from inside of the capping, which formations have outward projections thereon and these formations locate in an upwardly open channel of the glazing bar which has a series of internal recesses or notches for receiving said projections. The provision of a series or recesses or notches for receiving the projections allows the resilient depending formations of the capping to be pressed down into the glazing bar any desired distance depending on the thickness of the roofing panel or panels which is or are being secured in place by the capping and make a snap fit.

The upwardly open channel preferably has converging sides leading to first notches. The converging sides may be planar or curved. The channel is preferably sufficiently deep with sufficient notches or recesses to receive a single size capping irrespective of the depth of the glazing panels being accommodated. A series of two notches or recesses on each side of the channel may be sufficient for most purposes provided the channel is deep enough.

A roof beam according to the invention may be formed for locating the roofing panel on one side thereof, such as when the other side of the beam is to be secured to a wall or may be formed for locating roofing panels on opposite sides thereof for use intermediate ends of the roof structure.

In one preferred embodiment of the invention, the edges of the cross bar may be in the form of troughs extending below the central section of the cross bar. The troughs of the cross bar are preferably formed with outer side walls that also have inwards returns. The side walls are preferably in planes parallel to the plane of the upstanding limb. The inward returns of the side walls preferably have arcuate top surfaces.

The overall height of the cross bar side walls may be chosen to receive transom and Victorian style lower cappings of the same or a similar depth, whilst the recess on the underside of the cross bar can accommodate the angled facets of the Victorian lower capping base. The glazing bars of the invention may also accommodate glazing panels at a variety of angles. Furthermore, as the same glazing bars may be used for transom situations and for roof end situations where glazing panels are angled relative to each other, it may be possible to use the same size top cappings on both rather than having to use a larger size top capping on the roof end glazing bars.

Where the cross bar recess is formed by continuations of side walls below the cross bar, these continuations may be shaped so as to provide means of engagement with cooperating formations of a lower capping for the glazing bar. Such engagements may comprise, for example, corresponding hook like formations or may comprise ribs that snap fit into channels. Such channels are preferably formed internally of the lower cappings.

Thus, with this type of formation for the cross bar, a capping having either a flat base or an angled facet base can be accommodated thereon, so that the need for two different formations of glazing bar can be eliminated. By having the top surfaces of the inward returned of the side walls arcuate or curved, integral gaskets on top edges of the capping can be accommodated irrespective of the angle of the co-extruded gasket.

The inward returns of the side walls preferably also have top surfaces that are profiled or roughened in order to provide improved grip for the capping on the underside of the cross bar especially for co-extruded gaskets on edges of cappings, which in use are sandwiched between the glazing bar and glazing panels.

Conveniently the troughs at each side of the glazing bar cross bar provide draining channels for collecting and directing water which has penetrated the roof beam. So that it can run off via the roof eaves. To improve drainage further, it is preferred that the central section of the glazing bar cross bar be inclined downwards from each side of its junction with the upstanding limb, so that any water collected in the glazing bar can run into the troughs. As any fixings made between the glazing bar and other conservatory components at the ridge or eaves will generally be made in the central section, such as by way of screws or bolts, it is advantageous to have the extra drainage facility, so that water cannot collect around such fixings and cause corrosion.

For some situations, especially in large conservatory constructions, where glazing bars will be unsupported over a considerable length, there is a risk of them twisting. Thus, a preferred glazing bar for the beam construction of the invention is of generally inverted T-section and has its upstanding limb in the form of a hollow section duct.

The upstanding limb of the glazing bar may be of any suitable cross section. One suitable cross section is a rectangular cross section but a tapered section either upwardly or downwardly, such as of a triangular cross section, may also be very suitable for the invention, especially in the form of an isosceles triangle either way up. A triangular section duct is believed to be advantageous in providing a self resolving shape for lateral forces.

Another type of glazing bar for use in this invention has two or more ducts, preferably spaced apart by single web stems. Preferably such ducts are of rectangular, especially square, section.

Generally the double web duct should be as small as possible without losing the advantage of strength. That is to facilitate extrusion of that type of glazing bar, say from aluminium or aluminium alloy, it being easier to extrude smaller rather than larger enclosed sections. A preferred shape for the duct has a flat top and convergent sides from the flat top to a curved base.

The ducts of preferred glazing bars for this invention, as well as giving torsional stability to the glazing bars, may also be used to carry service cabling or piping and to provide locations for connecting members, such as fixing cleats or brackets of a tennon type. Furthermore, hollow duct glazing bar have improved "U" values compared to single stem glazing bars.

Glazing bars for the invention may be secured to other components of a roof system by means of screws, bolts or the like through the cross bars thereof. However, for some situations end fixing of glazing bars may be desirable. For that purpose the upstanding limb of a glazing bar may be formed with a screw or bolt port to receive same in a longitudinal direction of the glazing bar. As the glazing bars used in the invention will normally be formed as extrusions, the port will run the length of a glazing bar section and be available, therefore, at opposite ends of the glazing bar to receive a screw, bolt or other suitable fixing.

For glazing bars having a single web upstanding limb, the screw port will conveniently be situated just above its junction with the cross bar or at the intersection of the upstanding limb and cross bar.

For glazing bars having their upstanding limb in the form of a hollow duct i.e. having two upstanding webs, the screw port may be formed as part of a the duct preferably either at or just above the base thereof. Alternatively, the screw port may be formed in a single web upstand between the cross bar and a double web duct.

The invention further provides a roof beam comprising a glazing bar of either aspect of the invention with upper and lower cappings fitted thereto.

A preferred lower capping is of extruded plastics material, such as PVC, and is preferably formed as a channel section with either a flat base or with a base having a pair of angled longitudinal facets the gasket material is preferably co-extruded or bonded onto the capping and is preferably of rubber or synthetic elastomeric material. The gaskets preferably extend inwards from opposite sides of the channel and may have deformable resilient ribs or the like, especially at edges and also possible centrally thereof to provide a good seal when compressed. Preferred gaskets are generally arcuate in section, so that they are concave on their underside. This feature may be of advantage in fitting the cappings to glazing bars by allowing more room for the gaskets to be slipped over edges of the glazing bar cross bar. Internally of the lower cappings are preferably one or more spaced projections or ribs to ensure correct alignment of the glazing bar and capping when fitted together.

The lower cappings may have their bases formed with a relatively flexible mid-section, which nay facilitate fitting thereof to glazing bars. In one preferred form the lower capping base is formed with a co-extruded rubber or elastomeric strip centrally thereof along its length.

BRIEF DESCRIPTION OF THE DRAWINGS

This invention will now be further described, by way of example only, with reference to the accompanying drawings, in which.

DETAILED DESCRIPTION OF THE ILLUSTRATED EMBODIMENTS

Figure 1:
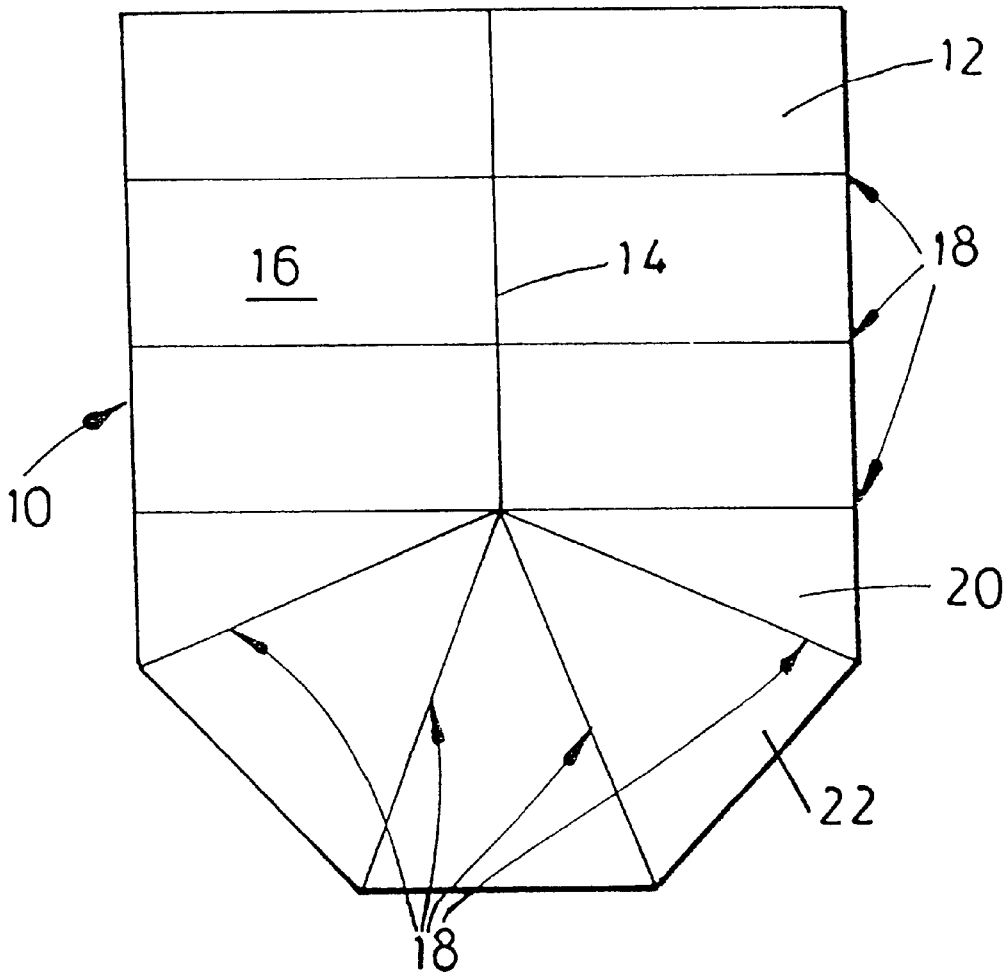
FIG. 1 is a schematic plan view of a typical Victorian style conservatory.

Referring to FIG. 1 of the accompanying drawings, a typically Victorian style conservatory 10 has a first part 12 having a central ridge 14 with rectangular roofing panels 16 sloping down from the ridge and supported between roof beams 18, hereinafter referred to as a transom situation. One end of the ridge 14 will usually abut another building and at the opposite end the ridge 14 has a bow end 20 having its roof formed of triangular section roofing panels 22 sloping down to the eaves, hereinafter referred to as a Victorian situation.

Figure 2:
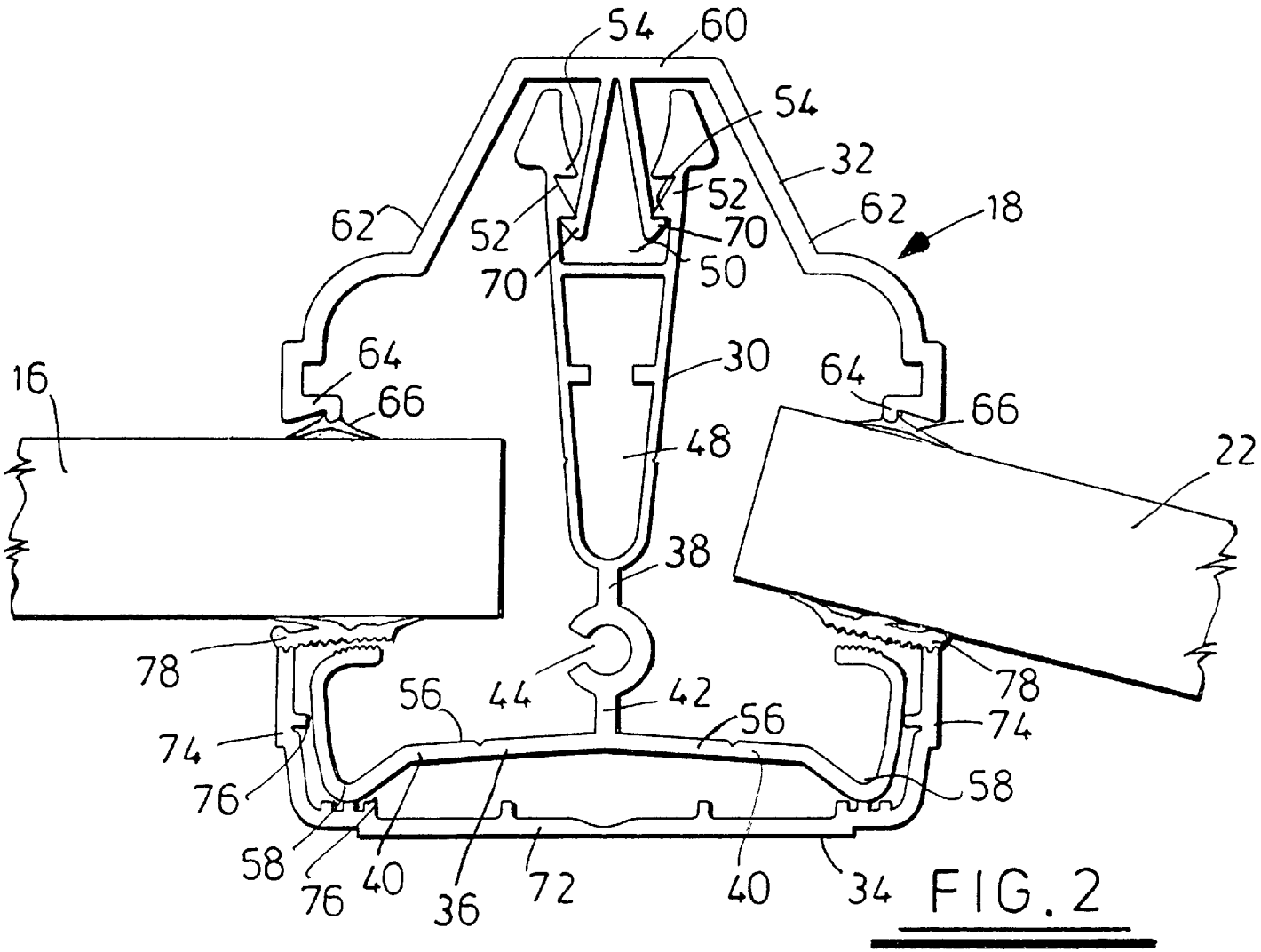
FIG. 2 shows a roof beam arrangement according to the invention with glazing panels in place.
Figure 3:
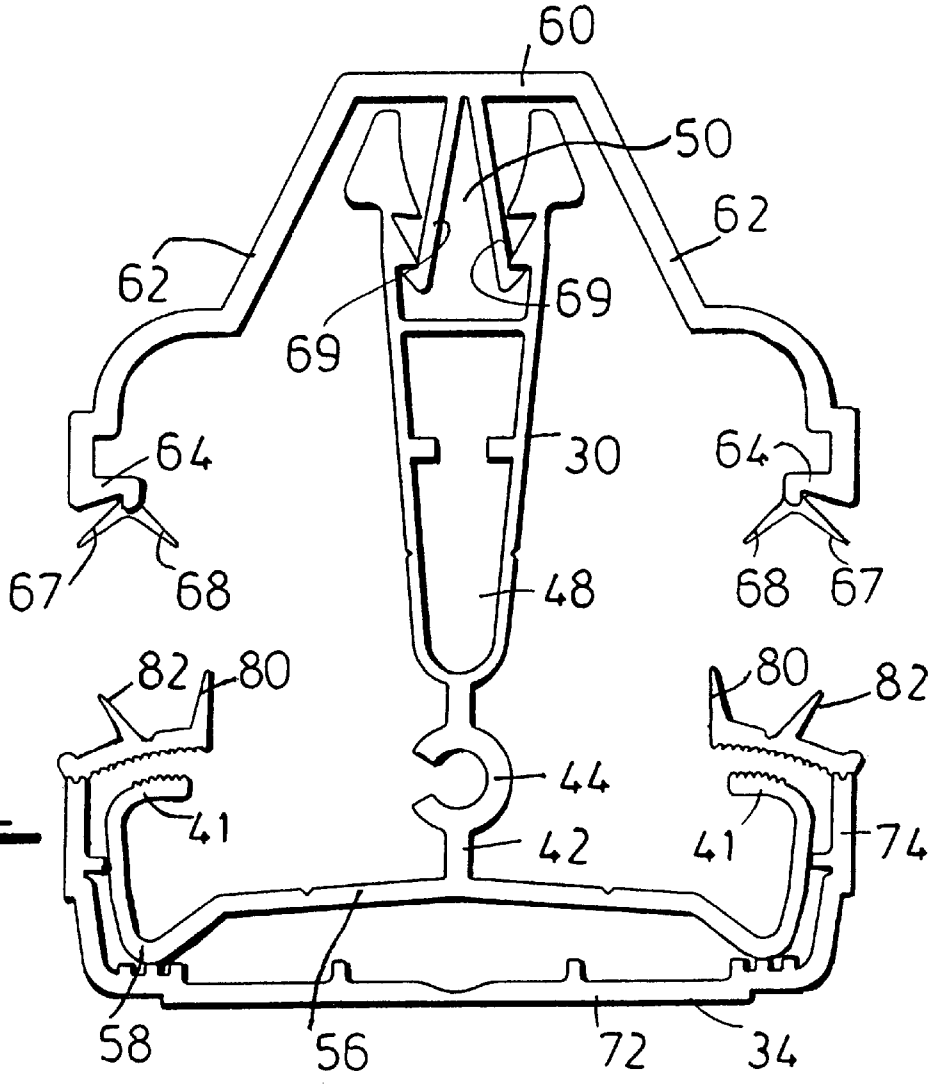
FIG. 3 shows the arrangement of FIG. 2 without glazing panels.

The roof beams 18 are of the type illustrated in FIGS. 2 and 3 of the accompanying drawings. Opposite sides of roof beams 18 in FIG. 2 are shown in the transom and Victorian situation, i.e. with glazing panels in place.

Roof beams 18 comprise a glazing bar 30, an upper capping 32 and a lower capping 34. In use roofing panels 16, 22, such as of translucent plastics material, for example polycarbonate, will have their edges sandwiched between the upper capping 32 and the lower capping 34 on opposite sides of the roof beam arrangement.

The glazing bar 30 is extruded from aluminium and is generally of T-section but inverted in use having a cross bar 36 and an upstanding limb 38. Thus, the glazing bar 30 has a pair of flanges 40 forming the cross bar which are turned back on themselves at their remote ends 41. The upstanding limb has a first part 42 extending from cross bar 36 that has a single web and includes a screw port 44 and a second double web ducted part 48. The top of the limb 48 forms an upwardly open channel 50 having sides 52. On the inside of each side 52 is a series of notches 54 forming downwardly open recesses.

Each flange 40 has a first part 56 generally sloping slightly downwards from the upstanding limb 38 and second part which forms a trough 58 remote from the upstanding limb 38. The upper capping 32 is extruded from PVC and is generally of inverted V-section but comprises a flat top 60 and shaped depending sides 62.

The sides 62 are stepped inwards at the bottom to form gasket receiving edges 64 inwards of the sides 62.

Rubber or synthetic elastomeric materials gaskets 66 are co-extruded or bonded onto the edges 64. The gaskets 66 are formed as strips having two divergent deformable sides 67, 68. As can be seen, when the upper capping is pressed onto the glazing bar, the gaskets 66 are hidden effectively by the overhang of the returned sides of the capping. Furthermore, the returned sides may provide the capping with greater resilience, so that the capping can form a good seal against the glazing panels and also to reduce the risk of the capping splitting where the sides join the top by application of excess force in fitting the capping. Internally of the capping 32 and depending from its flat top 60 are a pair of resilient divergent flaps 69 having outwardly projecting lips 70 at their ends.

The lower capping 34 is also extruded from plastics material, such as PVC, and is generally formed as a channel section having a base 72 and upstanding side walls 74. Internally of the channel on the base 72 and on the side walls 74 are spacing projections 76. The free edges of the side walls 74 have co-extruded or bonded thereon, from rubber or synthetic elastomeric material gaskets 78 which extend inwardly and are included slightly upwardly. The gaskets 78 include resilient deformable projections 80 and 82 on their upper surface along their outermost edge and centrally thereof respectively.

Figures 4, 5:
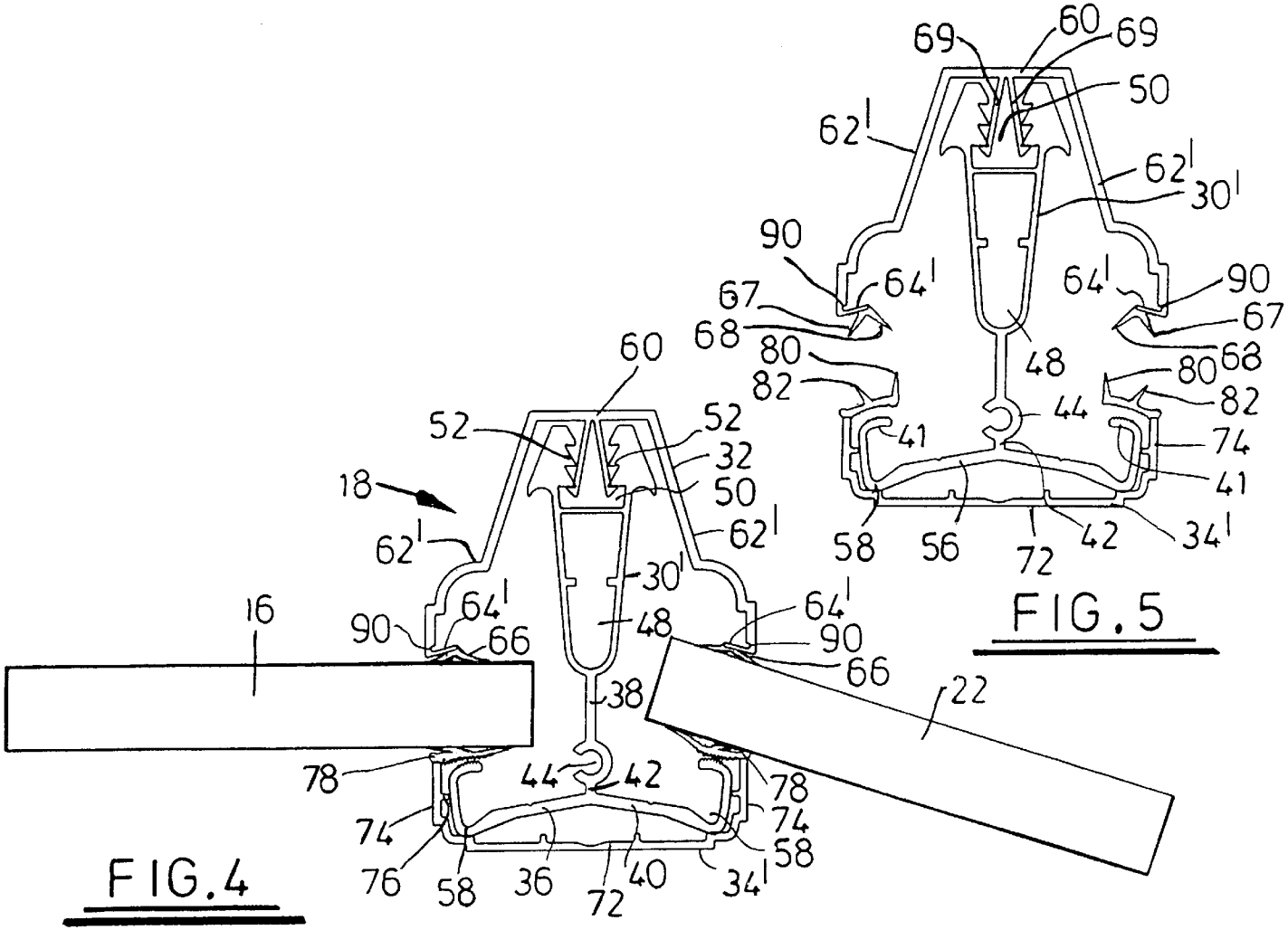
FIG. 4 shows a variation on the embodiment of FIGS. 1 and 2 with glazing panels in place.
FIG. 5 shows the variation of FIG. 4 without glazing panels.

Turning to FIGS. 4 and 5 of the accompanying drawings, in which like parts to those of the embodiment of FIGS. 2 and 3 have been given the same reference numbers, there is a modification to the stepped edges 64. In FIGS. 4 and 5, the upper capping has inwards edges 64' that are thinner and that are flexible relative to the capping sides 62' by means of lines of weakness 90 formed by thinning of the material where the sides 62' and edges 64' meet. Thus, the edges 64' are resiliently flexible, so as to allow a spring action to urge the gaskets 66 onto the glazing panels 16 to improve the seal.

In other respects, the embodiment of FIGS. 4 and 5 corresponds to the embodiment of FIGS. 2 and 3, except for slight variations in the respective glazing bars 30 and 30' and bottom cappings 34 and 34'.

In FIGS. 2 to 5 the lower capping 34 is for a transom roof beam but the same glazing bar and upper capping 32 or 32' can be used with a different lower capping (not shown) to form a Victorian style roof beam, in which the lower capping has its base formed from a pair of longitudinal facets angles relative to each other to form a concave surface when viewed from below. The capping has side walls each perpendicular to its adjoining facet. Such an arrangement is illustrated in GB2315800A.

What is claimed is:

1. A roof beam for use in constructing conservatory roofs, said roof beam comprising a glazing bar and an upper capping having gaskets along edges of the upper capping for sealing on a glazing panel to be supported by the glazing bar, and means for locating the upper capping on the glazing bar, wherein the upper capping has two sides stepped inwardly and forming inwards returns having inwards ends, wherein the upper capping has gasket material on the inward ends, and wherein the inwards returns are connected to the sides of the upper capping by lines of weakness allowing the inwards returns to flex relative to the sides.

2. A roof beam as claimed in claim 1, wherein the gasket material is provided on the upper capping by co-extrusion.

3. A roof beam as claimed in claim 1, wherein the gasket material is provided on the upper capping by co-bonding.

4. A roof beam as claimed in claim 1, wherein the upper capping is an extrusion of plastics material.

5. A roof beam as claimed in claim 4, wherein the plastics material is polyvinyl chloride.

6. A roof beam as claimed in claim 1, wherein the gasket material is of rubber or synthetic elastomeric material.

7. A roof beam as claimed in claim 1, wherein the gasket material is in the form of a strip having two divergent facets that spread outwardly in use.

8. A roof beam as claimed in claim 1, wherein, internally of the capping, formations are provided whereby the capping is coupled to the glazing bar.

9. A roof beam as claimed in claim 8, wherein resilient formations depend from inside of the capping, which formations have outward projections thereon and these formations locate in an upwardly open channel of the glazing bar which has a series of internal recesses or notches for receiving said projections.

10. A roof beam as claimed in claim 9, wherein the upwardly open channel has converging sides leading to first notches.

11. A roof beam as claimed in claim 10, wherein the converging sides of the channel are planar or curved.

12. A roof beam as claimed in claim 11, wherein the channel has notches or recesses to receive a single size capping irrespective of the depth of the glazing panels being accommodated.

13. A roof beam as claimed in claim 12, wherein each side of the channel has a series of two notches or recesses.

14. A roof beam as claimed in claim 1, wherein the glazing bar if T-cross section, inverted in use, having cross bar and upstand.

15. A roof beam as claimed in claim 14, wherein the edges of the cross bar are in the form of troughs extending below the central section of the cross bar to form a recess thereunder.

16. A roof beam as claimed in claim 15, wherein the troughs of the cross bar are formed with outer sidewalls that also have inwards returns.

17. A roof beam as claimed in claim 16, wherein the upstand defines a plane and wherein the sides are in planes parallel to said plane.

18. A roof beam as claimed in claim 16, wherein the inward returns of the sidewalls have arcuate top surfaces.

19. A roof beam as claimed in claim 1 further comprising a lower capping having gasket material on edges thereof for sealing under roofing panels supported by the glazing bar.

20. A roof beam as claimed in claim 15, wherein where the cross bar recess is formed by continuations of side walls below the cross bar, these continuations are shaped so as to provide means of engagement with cooperating formations of a lower capping for the glazing bar.

21. A roof beam as claimed in claim 16, wherein the side walls have top surfaces that are adapted to provide grip for the lower capping.

22. A roof beam as claimed in claim 21, wherein the lower capping is retained on the glazing bar by means of its gasket material being trapped between the cross bar and the roofing panels.

23. A roof beam as claimed in claim 14, wherein the glazing bar has its upstanding limb in the form of a hollow section duct.

24. A roof beam as claimed in claim 23, wherein the duct is of triangular cross section.

25. A roof beam as claimed in claim 19, wherein the lower capping is of extruded plastics material.

26. A roof beam as claimed in claim 25, wherein the lower capping is of PVC.

27. A roof beam as claimed in claim 25, wherein the lower capping is formed as a channel section with one of a flat base and a base having a pair of angled longitudinal facets.

* * * * *